US008313160B2

(12) United States Patent
Matsuo

(10) Patent No.: US 8,313,160 B2
(45) Date of Patent: Nov. 20, 2012

(54) LIQUID EJECTING APPARATUS

(75) Inventor: Hiroyuki Matsuo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 209 days.

(21) Appl. No.: 12/914,437

(22) Filed: Oct. 28, 2010

(65) Prior Publication Data

US 2011/0134176 A1 Jun. 9, 2011

(30) Foreign Application Priority Data

Dec. 7, 2009 (JP) ..... 2009-277236

(51) Int. Cl.
*B41J 29/38* (2006.01)

(52) U.S. Cl. ..... 347/10; 347/5; 347/11

(58) Field of Classification Search ..... 347/5, 9–11, 347/14, 19

See application file for complete search history.

(56) References Cited

U.S. PATENT DOCUMENTS 6,629,741 B1 * 10/2003 Okuda et al. ..... 347/11
6,851,780 B2 * 2/2005 Fujimura et al. ..... 347/11

FOREIGN PATENT DOCUMENTS

JP 2003-175599 6/2003

* cited by examiner

*Primary Examiner* — Juanita D Jackson
(74) *Attorney, Agent, or Firm* — Workman Nydegger

(57) ABSTRACT

The driving signal generation unit generates a leading driving pulse that is ahead in a unit cycle and a following driving pulse that follows the leading driving pulse; the leading driving pulse is set so that, in the case where liquid droplets are ejected simultaneously from multiple adjacent nozzles, the flight speed of the ejected liquid droplets located toward the central area in a nozzle row direction is higher than the flight speed of the ejected liquid droplets located toward the end areas in the nozzle row direction; and the following driving pulse is set so that, of the liquid droplets simultaneously ejected from the multiple adjacent nozzles, the flight speed of the ejected liquid droplets located toward the end areas is higher than the flight speed of the liquid droplets located toward the central area.

5 Claims, 6 Drawing Sheets

LIQUID EJECTING APPARATUS

The entire disclosure of Japanese Patent Application No: 2009-277236, filed Dec. 7, 2009 are expressly incorporated by reference herein.

BACKGROUND

1. Technical Field

The present invention relates to liquid ejecting apparatuses such as ink jet printers, and particularly relates to a liquid ejecting apparatus capable of controlling the ejection of a liquid by applying an ejection driving pulse to a pressurizing unit.

2. Related Art

A liquid ejecting apparatus is an apparatus that is provided with a liquid ejecting head capable of ejecting a liquid from a nozzle, and that ejects various types of liquids from this liquid ejecting head. An image recording apparatus such as an ink jet printer (called simply a "printer" hereinafter) that is provided with an ink jet recording head (called simply a "recording head" hereinafter) as its liquid ejecting head and that records images and so on by causing ink in liquid form to be ejected from a nozzle in the recording head and land upon a recording medium such as a recording sheet (an ejection target) can be given as a representative example of such a liquid ejecting apparatus. Meanwhile, in addition to such image recording apparatuses, liquid ejecting apparatuses are recently being applied in various types of manufacturing apparatuses, such as apparatuses for manufacturing color filters for liquid crystal displays.

For example, the stated printers include printers that have a nozzle row (a type of nozzle group) configured by arranging multiple nozzles in a row, the printers being configured so that an ejection driving pulse is applied to a pressurizing unit (for example, a piezoelectric element, a heat generating element, or the like) in order to drive the unit, changing the pressure of the liquid within a pressure chamber, and employing the pressure change to eject the liquid from the nozzles, which communicate with the pressure chamber. To be more specific, a driving signal including one or more ejection driving pulses within a unit cycle, which is the unit by which the driving signal repeats (specifically, a cycle defined by a timing signal such as a LAT signal or the like), is generated, a number of ink ejections equivalent to the number of ejection driving pulses applied to the pressurizing unit are instigated, and dots are formed by causing the ink to land upon that recording medium. Images or the like are formed upon the recording medium by collections of multiple dots. According to this configuration, the size of pixels, which are the units of which the images or the like are formed, can be adjusted by increasing/decreasing the number of ink ejections within the unit cycle. In other words, multi-tone recording can be carried out by increasing/decreasing the number of inks.

However, in the case where, for example, high-speed printing is carried out on a roll of paper or the like serving as the recording medium at a printing speed in excess of 100 m per minute, the relative speed between the recording head and the recording medium increases, and there is thus a risk that multiple inks ejected from the same nozzle during the unit cycle will land in locations that are skewed relative to each other in the stated relative movement direction. This skew in the landing positions of dots has been a cause of drops in the quality of images and the like. Accordingly, to enable such high-speed printing, a scheme has been proposed in which, in a configuration that ejects ink (ink droplets) twice in succession from the same nozzle within a unit cycle, the flight speed of the second ejected ink droplet is set to be faster than the flight speed of the first ejected ink droplet, thus causing the ink droplets to combine in flight, resulting in the ink droplets landing upon the recording medium as a single ink droplet (see, for example, Patent Document JP-A-2003-175599).

Incidentally, with this type of printer, when ink is ejected simultaneously from multiple nozzles that are adjacent to each other in a nozzle row, vibrations or the like caused by the aforementioned pressure fluctuations, driving of the pressurizing unit, and so on among the nozzles mutually affect the respective nozzles, and this has posed a problem in that so-called crosstalk, in which the ejection properties such as the flight speed, amount (mass or volume), and so on of the ejected ink has occurred between cases where ink is ejected singly from one nozzle and cases where ink is ejected simultaneously from multiple adjacent nozzles. There is a trend, particularly in recent years, for nozzles to be formed at high densities in order to meet demand for improvements in the image quality of recorded images. When nozzles are disposed at high densities, there has been a problem in that crosstalk occurs with ease when inks are ejected simultaneously from adjacent nozzles. The influence of crosstalk can be suppressed by reducing the flight speed of the ink; however, it should be noted that this poses a problem in that the flight speed, ink amount (mass or volume), and so on that are required for the aforementioned high-speed printing cannot be ensured.

FIGS. 6A through 6C are diagrams illustrating the influence of crosstalk when ink is ejected in a past printer, and are, to be more specific, diagrams illustrating conditions arising when ink is ejected from nozzles of which a nozzle row is configured toward a recording medium as viewed from the direction perpendicular to the flight direction of the ink (that is, the lateral direction). Note that in FIGS. 6A through 6C, the straight lines in the upper areas indicate the nozzle surface of the recording head, whereas the straight lines in the lower areas indicate the recording surface (printing surface) of the recording medium. Furthermore, FIGS. 6A through 6C illustrate the flight conditions of ink droplets in the case where, of nozzles #1 through #15, ink is ejected from nozzles #1 through #6 and #10 through #15, whereas ink is not ejected from nozzles #7 through #9 (that is, six nozzles on and three nozzles off). Note that the nozzles #1 through #6 and the nozzles #10 through #15 configure individual respective nozzle groups (adjacent nozzle groups).

FIG. 6A illustrates the flight conditions of ink droplets ejected by the leading ejection driving pulse in the case where ink is ejected using two ejection driving pulses within the unit cycle.

In a case such as this, where ink is ejected simultaneously from multiple adjacent nozzles, vibrations and the like occurring at that time exert mutual influence among the nozzles that are adjacent to each other, and thus there is a trend for the flight speed of the ink to drop in nozzles that are located closer to the central portions of the adjacent nozzle groups and the flight speed of ink to increase in nozzles that are located closer to the outer end portions of the adjacent nozzle groups. Accordingly, observing the respective ink droplets that are ejected from these nozzle groups shows that the inks travel in a state in which the ink droplets toward the central portion are closer to the nozzle surface and the ink droplets toward the outer end portions are closer to the recording medium, or in other words, a state in which the ink droplets form an arched shape whose central portion bulges upward (toward the nozzle surface). The trend toward the stated arched shape is particularly strong as the flight speed of the ink droplets is increased to comply with applications such as high-speed printing. Meanwhile, as shown in FIG. 6B, the inks also travel in a state that is essentially an arched shape whose central portion bulges upward even in the case where ink is ejected simultaneously from multiple adjacent nozzles as a result of the second ejection driving pulse in the unit cycle. Accordingly, as shown in FIG. 6C, even if the leading ink droplets and the following ink droplets combine during flight, observing the post-combination ink droplets shows that the inks travel in a state that is essentially an arched shape whose central portion bulges upward.

Here, ink droplets that have a higher flight speed land upon the recording medium in a shorter amount of time, and the time it takes for an ink droplet to land upon the recording medium is longer, the slower the flight speed is. In a configuration in which printing is carried out while the recording head and the recording medium move relative to each other, the locations at which the inks land upon the recording medium differ depending on the flight speeds of the ink. Accordingly, groups of dots formed when the inks land upon the recording medium are curved into an arched shape when viewed from above. This has resulted in a problem in that the quality of the recorded image or the like has decreased.

SUMMARY

An advantage of some aspects of the invention is to provide a liquid ejecting apparatus that, in a configuration in which multiple liquid droplets are ejected in a unit cycle and the liquid droplets combine prior to landing upon a landing target, is capable of suppressing differences in the flight speeds of the post-combination ink droplets.

A first aspect of the invention is a liquid ejecting apparatus including a liquid ejecting head that has a nozzle that ejects a liquid, a pressure chamber that communicates with the nozzle, and a pressurizing unit that causes a pressure change in a liquid within the pressure chamber, the liquid ejecting head being capable of ejecting the liquid from the nozzle as a result of an operation performed by the pressurizing unit, and a driving signal generation unit that generates a driving signal including an ejection driving pulse for driving the pressurizing unit and causing the liquid to be ejected from the nozzle, the liquid ejecting apparatus causing liquid droplets to be ejected from the nozzle and land upon a landing target while moving the landing target and the liquid ejecting head relative to each other using the movement unit. The driving signal generation unit generates a leading driving pulse that is ahead in a unit cycle and a following driving pulse that follows the leading driving pulse; the leading driving pulse is set so that, in the case where liquid droplets are ejected simultaneously from multiple adjacent nozzles, the flight speed of the ejected liquid droplets located toward the central area in a nozzle row direction is higher than the flight speed of the ejected liquid droplets located toward the end areas in the nozzle row direction; and the following driving pulse is set so that, of the liquid droplets simultaneously ejected from the multiple adjacent nozzles, the flight speed of the ejected liquid droplets located toward the end areas is higher than the flight speed of the liquid droplets located toward the central area.

It is desirable, in the stated configuration, for the flight speed of the liquid droplets that are ejected from the nozzles as a result of the following driving pulse and that are located on the end areas to be greater than or equal to 1.1 times and less than or equal to 3.6 times the flight speed of the liquid droplets that are ejected from the nozzles as a result of the leading driving pulse and that are located on the end areas.

According to this aspect of the invention, the leading driving pulse is set so that, in the case where liquid droplets are ejected simultaneously from multiple adjacent nozzles, the flight speed of the ejected liquid droplets located toward the central area in a nozzle row direction is higher than the flight speed of the ejected liquid droplets located toward the end areas in the nozzle row direction, and the following driving pulse is set so that, of the liquid droplets simultaneously ejected from the multiple adjacent nozzles, the flight speed of the ejected liquid droplets located toward the end areas is higher than the flight speed of the liquid droplets located toward the central area. Accordingly, when liquid droplets are ejected simultaneously from multiple nozzles as a result of the following driving pulse after liquid droplets are ejected simultaneously from the multiple nozzles as a result of the leading driving pulse within a unit cycle, the leading liquid droplets and the following liquid droplets combine, and the combined liquid droplets travel toward the landing target essentially in a straight horizontal line. Accordingly, the dot groups formed when the liquid droplets land upon the landing target are also arranged along a single straight line when viewed from above. In other words, skew in the landing positions of the liquid droplets in the direction perpendicular to the nozzle row direction (that is, the relative movement direction of the liquid ejecting head and the landing target) is suppressed. As a result, a drop in the quality of the image or the like recorded on the landing target is suppressed.

Another aspect of the invention is a liquid ejecting apparatus including a liquid ejecting head that has a nozzle that ejects a liquid, a pressure chamber that communicates with the nozzle, and a pressurizing unit that causes a pressure change in a liquid within the pressure chamber, the liquid ejecting head being capable of ejecting the liquid from the nozzle as a result of an operation performed by the pressurizing unit, and a driving signal generation unit that generates a driving signal including an ejection driving pulse for driving the pressurizing unit and causing the liquid to be ejected from the nozzle, the liquid ejecting apparatus causing liquid droplets to be ejected from the nozzle and land upon a landing target while moving the landing target and the liquid ejecting head relative to each other using the movement unit. The driving signal generation unit generates a leading driving pulse that is ahead in a unit cycle and a following driving pulse that follows the leading driving pulse; the leading driving pulse is a voltage waveform including a first retraction portion for changing the potential in a first direction and retracting the meniscus at the nozzle toward the pressure chamber, a first hold portion in which the ending potential of the first retraction portion is held constant, and a first expulsion portion for changing the potential in a second direction that is the direction opposite to the first direction and pushing the meniscus that has been retracted by the first retraction portion outward in the ejection direction; the following driving pulse is a voltage waveform including a second retraction portion for changing the potential in the first direction and retracting the meniscus at the nozzle toward the pressure chamber, a second hold portion in which the ending potential of the second retraction portion is held constant, and a second expulsion portion for changing the potential in the second direction and pushing the meniscus that has been retracted by the second retraction portion outward in the ejection direction; the second expulsion portion is configured of a former-stage expulsion element in which the potential changes from the ending potential of the second retraction portion to the second direction, an intermediate hold element in which the ending potential of the former-stage expulsion element is held constant, and a latter-stage expulsion element in which the potential changes from the ending potential of the former-stage expulsion element to the second direction; and when the unique vibration cycle of the liquid within the pressure chamber is taken as Tc, the duration of the first retraction portion is greater than or equal to 0.2 Tc and less than or equal to 0.3 Tc.

It is desirable, in the stated configuration, to employ a configuration in which the period from the end of the leading driving pulse to the beginning of the following driving pulse is greater than or equal to 0.2 Tc and less than or equal to 0.3 Tc.

Furthermore, it is desirable, in the stated configuration, to employ a configuration in which the duration of the second retraction portion of the following driving pulse is set to be longer than the duration of the first retraction portion of the leading driving pulse, and the duration of the first hold portion of the leading driving pulse is set to be longer than the duration of the second hold portion of the following driving pulse.

According to the invention, when liquid droplets are ejected simultaneously from multiple nozzles as a result of the following driving pulse after liquid droplets are ejected simultaneously from the multiple nozzles as a result of the leading driving pulse within a unit cycle, the leading liquid droplets and the following liquid droplets combine, and the combined liquid droplets travel toward the landing target essentially in a straight horizontal line. Accordingly, the dot groups formed when the liquid droplets land upon the landing target are also arranged along a single straight line when viewed from above. In other words, positional skew in the liquid droplets is suppressed. As a result, a drop in the quality of the image or the like recorded on the landing target is suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the appended drawings. Although various limitations are made in the embodiment described hereinafter in order to illustrate a specific preferred example of the invention, it should be noted that the scope of the invention is not intended to be limited to this embodiment unless such limitations are explicitly mentioned hereinafter. An ink jet recording apparatus (referred to as a "printer") will be given hereinafter as an example of a liquid ejecting apparatus according to the invention.

Figure 1:
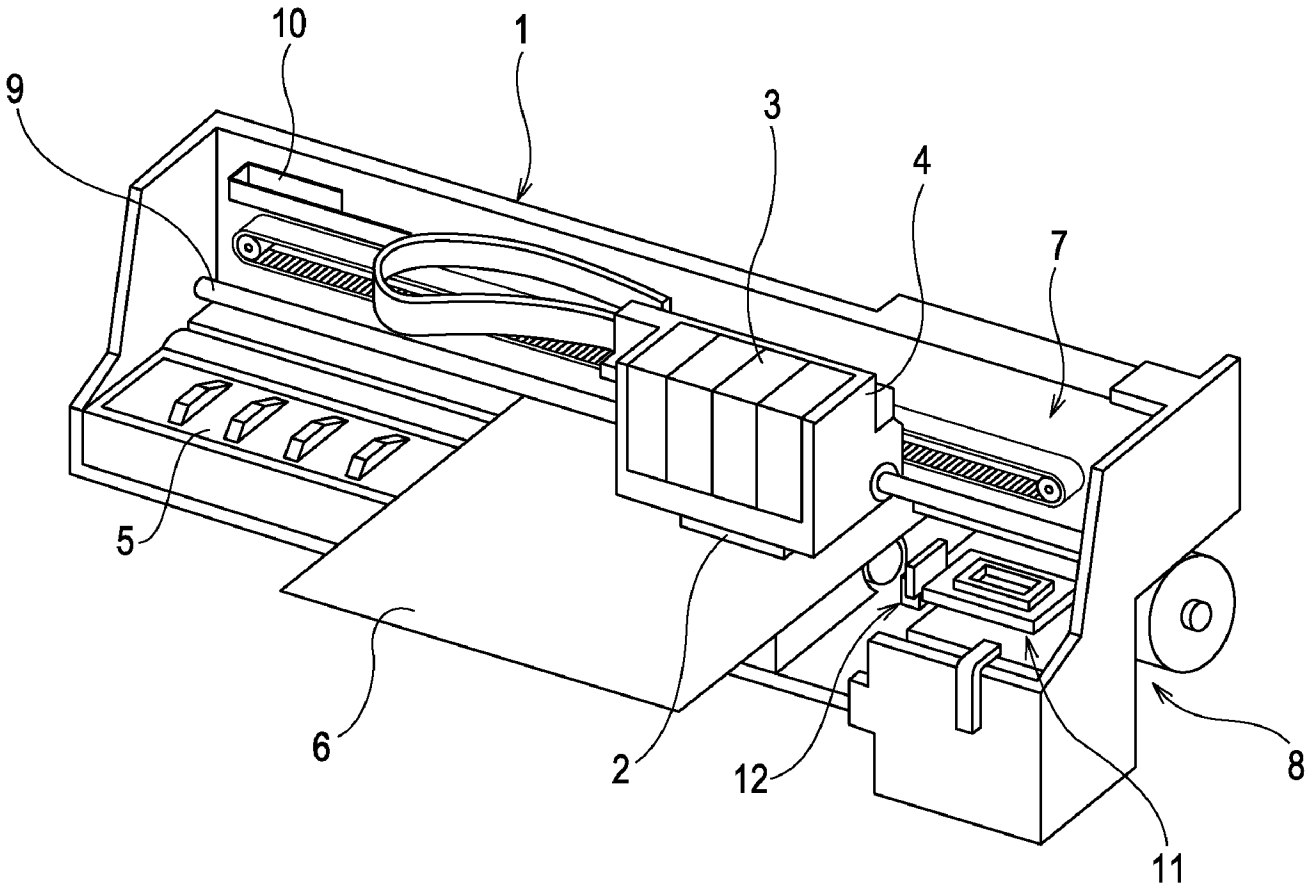
FIG. 1 is a perspective view illustrating the overall configuration of a printer.

FIG. 1 is a perspective view illustrating the configuration of a printer 1. The printer 1 is generally configured so as to include: a carriage 4 to which is attached a recording head 2 serving as a liquid ejecting head and an ink cartridge 3 (a type of liquid holding unit), the ink cartridge 3 being attached in a removable state; a platen 5 disposed below the recording head 2; a carriage movement mechanism 7 (a type of movement unit) that moves the carriage 4 back and forth in a paper width direction of recording paper 6 (a type of landing target) serving as a recording medium, or in other words, in the main scanning direction; and a paper feed mechanism 8 that transports the recording paper 6 in the sub scanning direction, which is perpendicular to the main scanning direction.

The carriage 4 is attached in a state in which it is pivotally supported by a guide rod 9 that is erected along the main scanning direction, and the configuration is such that the carriage 4 moves in the main scanning direction along the guide rod 9 as a result of operations performed by the carriage movement mechanism 7. The position of the carriage 4 in the main scanning direction is detected by a linear encoder 10, and that detection signal, or in other words, an encoder pulse is sent to a control unit 41 of a printer controller 35 (see FIG. 3). Accordingly, the control unit 41 can control recording operations (ejection operations) and the like of the recording head 2 while recognizing the scanning location of the carriage 4 (the recording head 2) based on the encoder pulse from the linear encoder 10.

A home position, which serves as a base point for scanning, is set within the movement range of the carriage 4 in an end region that is outside of the recording region. A capping member 11 that seals a nozzle formation surface of the recording head 2 (that is, a nozzle substrate 21; see FIG. 2) and a wiper member 12 for wiping the nozzle formation surface are provided at the home position in this embodiment. The printer 1 is configured so as to be capable of so-called bidirectional recording, in which text, images, or the like are recorded upon the recording paper 6 both when the carriage 4 (the recording head 2) is outbound, moving toward the end that is on the opposite side of the home position, and when the carriage 4 is inbound, returning toward the home position from the end that is on the opposite side of the home position. In other words, the configuration is such that ink droplets are ejected from nozzles 27 in the recording head 2 and land upon the recording paper 6 while the recording head 2 and the recording paper 6 move relative to each other.

Figure 2:
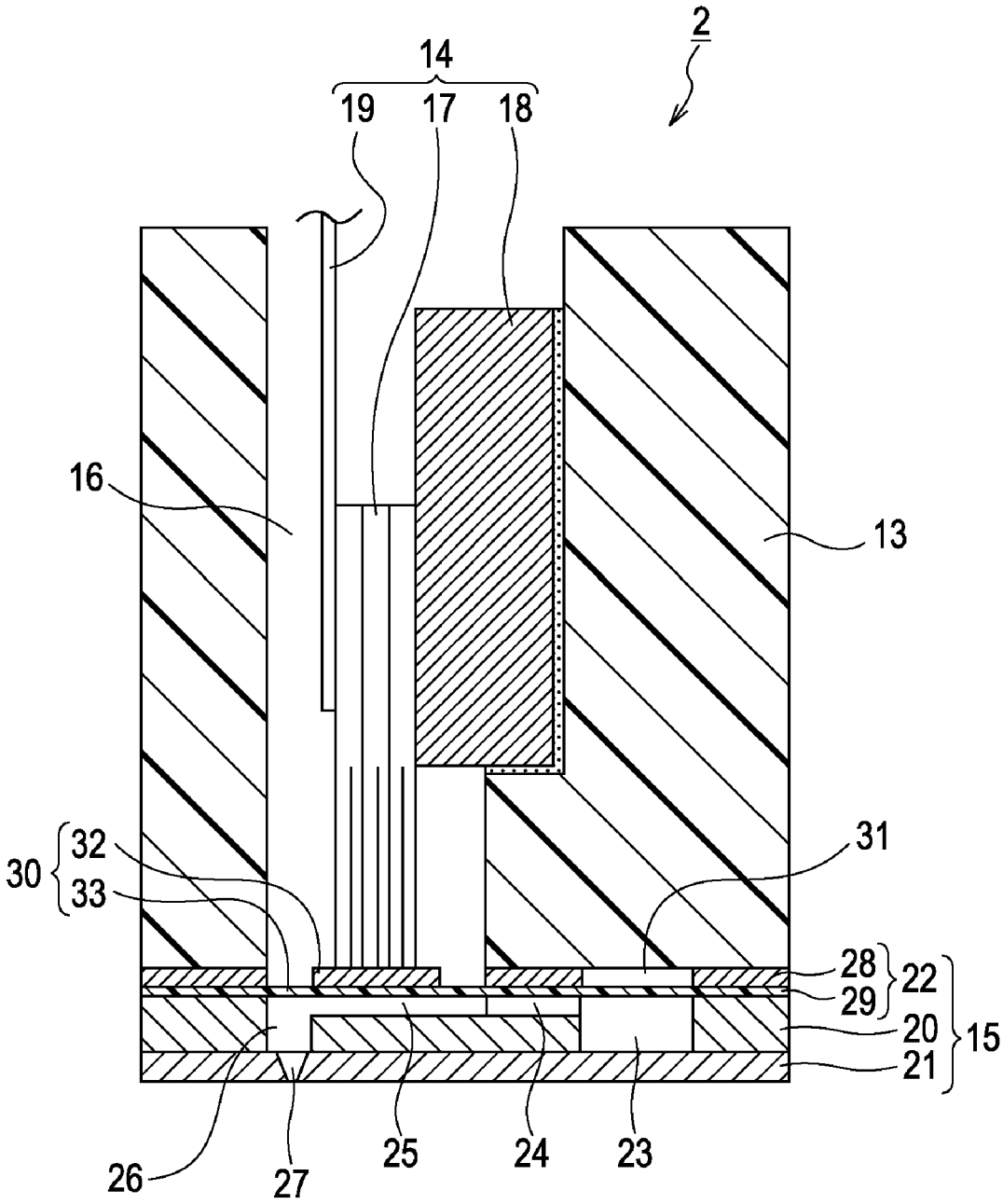
FIG. 2 is a cross-sectional view illustrating the principal constituent elements of a recording head.

FIG. 2 is a cross-sectional view of the principal portion illustrating the principal constituent elements of the stated recording head 2. The recording head 2 includes a case 13, a vibrator unit 14 that is housed within the case 13, a flow channel unit 15 that is bonded to the bottom surface (the end surface) of the case 13, and so on. The case 13 is created using, for example, an epoxy resin; a housing cavity 16 for housing the vibrator unit 14 is formed within the case 13. The vibrator unit 14 includes a piezoelectric element 17 that functions as a type of pressurizing unit, an anchor plate 18 that is bonded to the piezoelectric element 17, and a flexible cable 19 for supplying driving signals and the like to the piezoelectric element 17. The piezoelectric element 17 is a stacked-type piezoelectric element created by cutting a piezoelectric plate formed by stacking piezoelectric layers and electrode layers in alternation with each other into a comb-tooth shape, and is a piezoelectric element of a longitudinally-vibrating mode that enables the piezoelectric element to expand and shrink in the direction perpendicular to the stacking direction.

The flow channel unit 15 is configured by bonding the nozzle substrate 21 to one surface of a flow channel substrate 20 and bonding an elastic plate 22 to the other surface of the flow channel substrate 20. The flow channel unit 15 is provided with a reservoir 23, an ink supply opening 24, a pressure chamber 25, a nozzle communication opening 26, and the nozzle 27. A serial ink flow channel that extends from the ink supply opening 24 to the nozzle 27, passing through the pressure chamber 25 and the nozzle communication opening 26, is formed in correspondence with each nozzle 27.

The nozzle substrate 21 is a plate member configured of a metallic plate such as stainless steel, a silicon single-crystal substrate, an organic plastic, or the like in which multiple nozzles 27 have been punched in row form at a pitch that corresponds to the dot formation density (for example, 180 dpi). Multiple rows of the nozzles 27 are provided in the nozzle substrate 21, and a single nozzle row (nozzle group) is configured of, for example, 180 nozzles 27. The recording head 2 according to this embodiment is configured so that four ink cartridges 3 holding inks (a type of liquid according to this invention) of different colors, or to be more specific, a total of four inks of the colors cyan (C), magenta (M), yellow (Y), and black (K), can be installed, and a total of four nozzle rows are formed in the nozzle substrate 21 in correspondence with those colors.

The stated elastic plate 22 has a dual-layer structure in which an elastic film 29 has been layered upon the surface of a support plate 28. In this embodiment, the elastic plate 22 is created using a complex plate material, in which a stainless steel plate, which is a type of metallic plate, is used as the support plate 28, and a resin film, serving as the elastic film 29, is laminated to the surface of the support plate 28. A diaphragm portion 30 that causes the volume of the pressure chamber 25 to change is provided in the elastic plate 22. Furthermore, a compliance portion 31 that partially seals the reservoir 23 is provided in the elastic plate 22.

The diaphragm portion 30 is created by partially removing the support plate 28 through an etching process or the like. In other words, the diaphragm portion 30 includes an island portion 32 that is affixed to the tip surface of the end of the piezoelectric element 17, and a thin elastic portion 33 that surrounds this island portion 32. The compliance portion 31 is created by removing the support plate 28 from the region opposite to the opening surface of the reservoir 23 using the same type of etching process as with the diaphragm portion 30, and functions as a damper that absorbs pressure fluctuations in the liquid held within the reservoir 23.

Because the tip surface of the piezoelectric element 17 is bonded to the island portion 32, the volume of the pressure chamber 25 can be changed by causing the free end of the piezoelectric element 17 to expand/shrink. Pressure fluctuations occur in the ink within the pressure chamber 25 as a result of this volume change. The recording head 2 ejects ink droplets (a type of liquid droplet) from the nozzles 27 using this pressure fluctuation.

Figure 3:
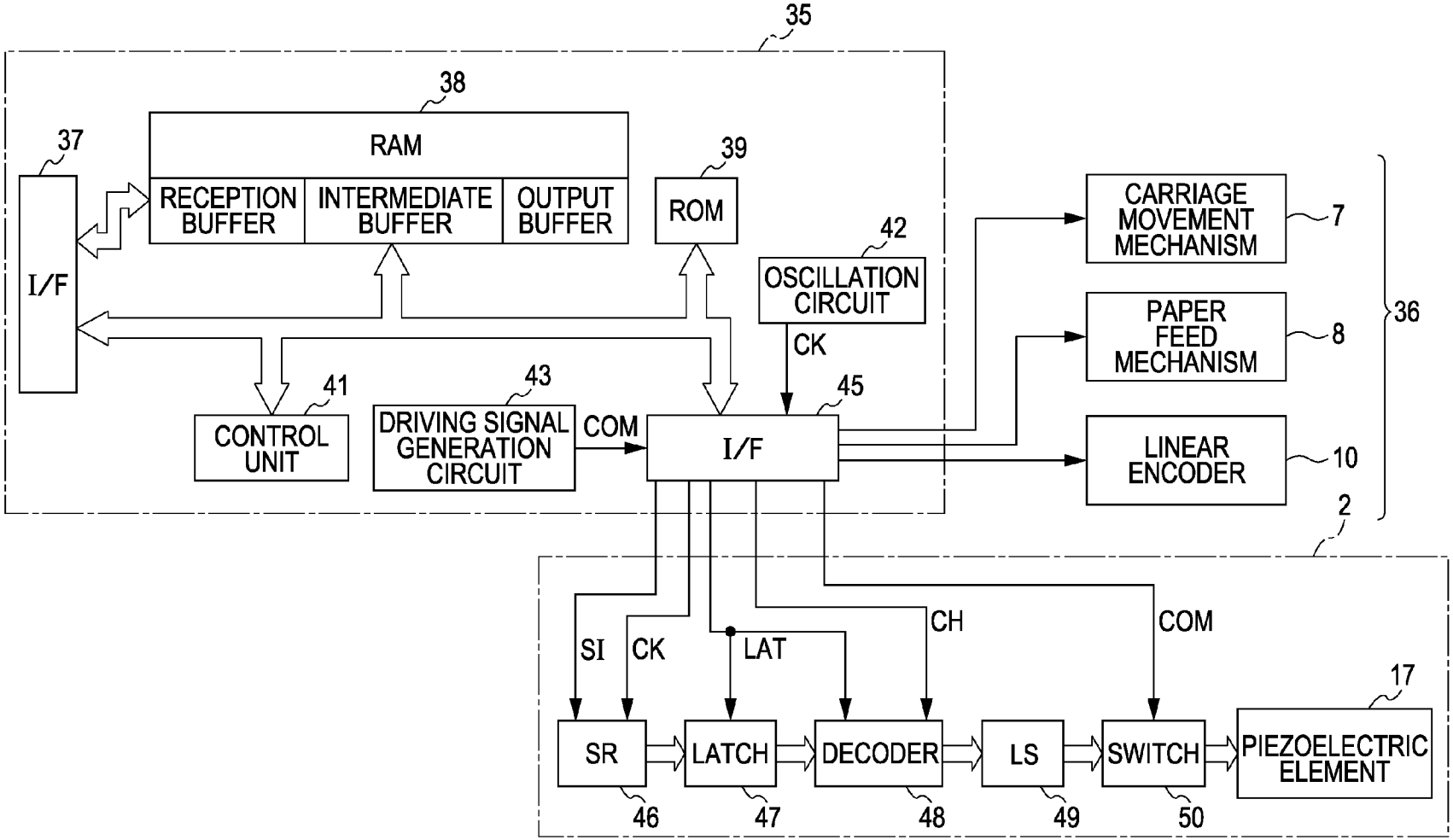
FIG. 3 is a block diagram illustrating the electrical configuration of a printer.

FIG. 3 is a block diagram illustrating the electrical configuration of the printer 1. This printer 1 is broadly configured of the printer controller 35 and a print engine 36. The printer controller 35 includes an external interface (external I/F) 37 through which print data or the like is inputted from an external apparatus such as a host computer; a RAM 38 that stores various types of data; a ROM 39 that stores control routines and the like for various types of data processes; the control unit 41 that controls the various units; an oscillation circuit 42 that emits a clock signal; a driving signal generation circuit 43 (a type of a driving signal generation unit according to the invention) that generates driving signals that are supplied to the recording head 2; and an internal interface (internal I/F) 45 for outputting pixel data obtained by expanding print data on a dot-by-dot basis, driving signals, and so on to the recording head 2.

The control unit 41 outputs a head control signal for controlling operations of the recording head 2 to the recording head 2, outputs a control signal for generating a driving signal COM to the driving signal generation circuit 43, and so on. The head control signal is, for example, a transfer clock CLK, pixel data SI, a latch signal LAT, and a change signal CH1. The latch signal, the change signal, and so on define the timings at which the various pulses that make up the driving signal COM are supplied.

In addition, the control unit 41 generates the pixel data SI to be used in ejection control of the recording head 2 by executing, based on the aforementioned print data, a color conversion process for conversion from the RGB color system to the CMY color system, a halftone process for reducing multi-tone data to a predetermined number of tones, a dot pattern expansion process for expanding the data that has undergone the halftone process into dot pattern data by arranging the data into predetermined arrays in ink type (that is, in each nozzle row), and so on. This pixel data SI is data regarding the pixels of the image that is to be printed, and is a type of ejection control information. Here, the "pixel" is the unit by which images, text, and so on are configured upon the recording medium such as recording paper, which is the landing target. There are cases where a pixel is made up of a single dot, and cases where a pixel is made up of multiple dots. The pixel data SI according to the invention is made up of tone data indicating the presence/absence of dots formed upon the recording medium (or the presence/absence of ink ejection) and the size of the dots (or the amount of ink ejected). In this embodiment, the pixel data SI is configured of binary tone data of a total of 2 bits. The 2-bit tone values include [00], which corresponds to no recording (a minute vibration) in which ink is not ejected, [01], which corresponds to the recording of a small dot, [10], which corresponds to the recording of a medium dot, and [11], which corresponds to the recording of a large dot. Accordingly, the printer according to this embodiment can record four tones.

The configuration of the print engine 36 will be described next. The print engine 36 is configured of the recording head 2, the carriage movement mechanism 7, the paper feed mechanism 8, and the linear encoder 10. The recording head 2 includes multiple shift registers (SR) 46, latches 47, decoders 48, level shifters (LS) 49, switches 50, and piezoelectric elements 17, corresponding to each of the nozzles 27. Pixel data (SI) from the printer controller 35 undergoes serial transmission to the shift register 46 in synchronization with the clock signal (CK) from the oscillation circuit 42.

The latch 47 is electrically connected to the shift register 46, and when a latch signal (LAT) is inputted into the latch 47 from the printer controller 35, the pixel data in the shift register 46 is latched. The pixel data latched in the latch 47 is inputted into the decoder 48. The decoder 48 translates the 2-bit pixel data and generates pulse selection data. The pulse selection data according to this embodiment is configured of data of a total of 2 bits.

The decoder 48 then outputs the pulse selection data to the level shifter 49 upon receiving the latch signal (LAT) or a channel signal (CH). In this case, the pulse selection data is inputted into the level shifter 49 starting with the most significant bit in order. The level shifter 49 functions as a voltage amplifier, and outputs, if the pulse selection data is "1", an electric signal having a voltage capable of driving the switch 50, or in other words, a voltage that has been boosted, for example, by approximately several tens of volts. The pulse selection data "1" boosted by the level shifter 49 is supplied to the switch 50. The driving signal COM from the driving signal generation circuit 43 is supplied to the input of the switch 50, and the piezoelectric element 17 is connected to the output of the switch 50.

The pulse selection data controls the operation of the switch 50, or in other words, controls the supply of an ejection pulse within the driving signal to the piezoelectric element 17. For example, during the period where the pulse selection data inputted into the switch 50 is "1", the switch 50 enters a connected state, and the corresponding ejection pulse is supplied to the piezoelectric element 17; the potential level of the piezoelectric element 17 changes in accordance with the waveform of the ejection pulse. Meanwhile, during the period where the pulse selection data is "0", no electric signal causing the switch 50 to operate is outputted from the level shifter 49. Accordingly, the switch 50 enters a disconnected state, and an ejection pulse is not supplied to the piezoelectric element 17.

Figure 4:
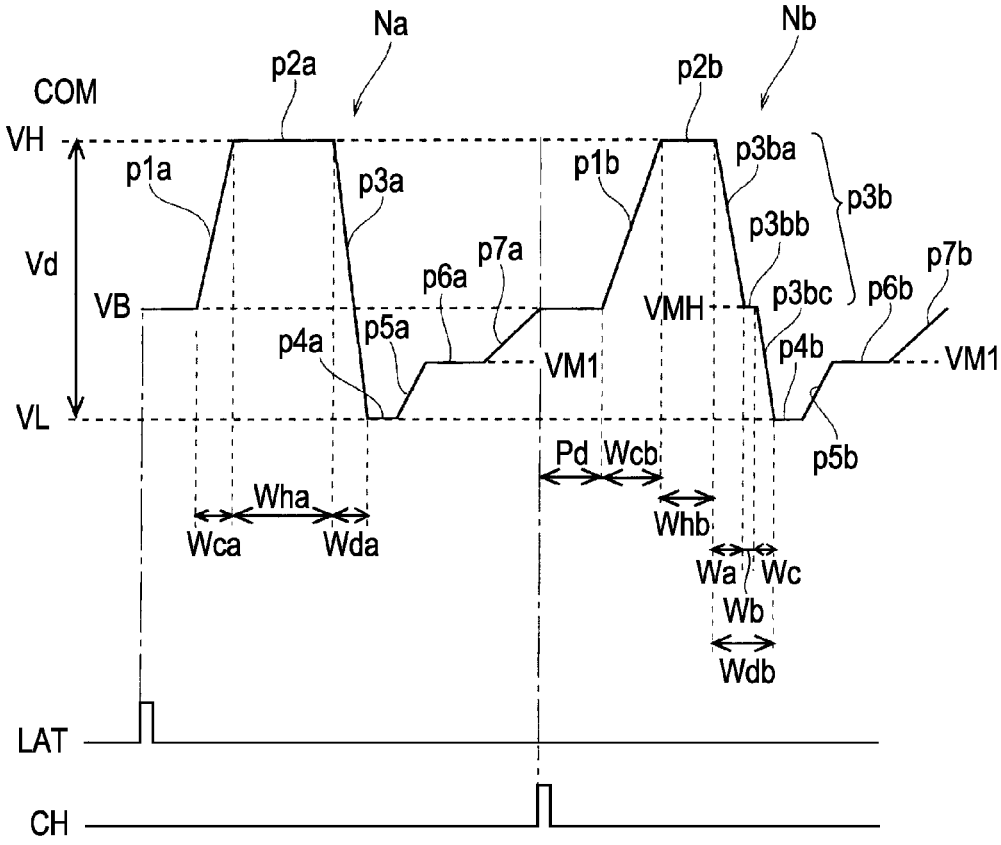
FIG. 4 is a waveform diagram illustrating the structure of an ejection driving pulse.

FIG. 4 is a diagram illustrating an example of the configuration of the driving signal COM generated by the driving signal generation circuit 43. The driving signal COM according to this embodiment is a serial signal in which multiple ejection driving pulses are present within unit cycles separated by timing signals (for example, LAT signals), or in other words, within the repetition cycle of the driving signal COM. The driving signal COM according to this embodiment is configured of a leading driving pulse Na that is emitted first in the unit cycle, and a following driving pulse Nb that is emitted after the leading pulse Na. An interval Pd from the end of the leading driving pulse Na (the end of a first return expansion portion p7*a*) to the start of the following driving pulse Nb (the start of a second preliminary expansion portion p1*b*) is, when the vibration cycle of the pressure vibrations that occur in the ink within the pressure chamber 25 is taken as Tc, set to be greater than or equal to 0.2 Tc and less than or equal to 0.3 Tc.

Here, the vibration cycle Tc is uniquely determined depending on the shapes, dimensions, durabilities, and so on of the nozzles 27, the pressure chambers 25, the ink supply openings 24, the piezoelectric elements 17, and so on. This unique vibration cycle Tc can be expressed by, for example, the following Formula (A).

$$Tc=2\pi\sqrt{[\{(Mn\times Ms)/(Mn+Ms)\}\times Cc]} \quad (A)$$

Note that in Formula (A), Mn expresses the inertance of the nozzle 27, Ms expresses the inertance of the ink supply opening 24, and Cc expresses the compliance (that is, the degree of capacity change or flexibility per unit of pressure) of the pressure chamber 25. Meanwhile, in the stated Formula (A), the inertances M indicate how easily the liquid within the flow channel such as the nozzles 27 will move, and is, to rephrase, the liquid mass per unit of cross-sectional area. The inertances M can be approximated through the following Formula (B), taking the ink density as ρ, the cross-sectional area of the surface perpendicular to the direction of the ink flow within the flow channel as S, and the length of the flow channel as L.

$$M=(\rho\times L)/S \quad (B)$$

Note that Tc is not limited to the cycle specified in the stated Formula (A), and may be any vibration cycle of the pressure chamber 25 of the recording head 2.

The leading driving pulse Na is designed so that the amount (mass or volume) of the ink droplet ejected from the nozzle 27 is lower and the flight speed of the ink droplet is slower than in the case of the following driving pulse Nb. The leading driving pulse Na is configured of a first preliminary expansion portion p1*a* (corresponding to a first retraction portion), a first expansion hold portion p2*a* (corresponding to a first hold portion), a first constriction portion p3*a* (corresponding to a first expulsion portion), a first constriction hold portion p4*a*, a first damping expansion portion p5*a*, a first damping hold portion p6*a*, and the first return expansion portion p7*a*. The first preliminary expansion portion p1*a* is a waveform portion in which the potential changes (rises) in the positive direction (corresponding to a first direction) from a base potential VB to an expansion potential VH at a constant slope, whereas the first expansion hold portion p2*a* is a waveform portion in which the ending potential of the first preliminary expansion portion p1*a*, or the expansion potential VH, is held constant. Meanwhile, the first constriction portion p3*a* is a waveform portion in which the potential changes (drops) in the negative direction (corresponding to a second direction) from the expansion potential VH to a constriction potential VL, whereas the first constriction hold portion p4*a* is a waveform portion in which the constriction potential VL is held constant. Furthermore, the first damping expansion portion p5*a* is a waveform portion in which the potential changes (rises) in the positive direction from the constriction potential VL to a damping expansion potential VM1 at a constant slope; the first damping hold portion p6*a* is a waveform portion in which the damping expansion potential VM1 is held constant; and the first return expansion portion p7*a* is a waveform portion in which the potential returns to the base potential VB from the damping expansion potential VM1.

Here, the duration (the time from the start to the end) Wca of the first preliminary expansion portion p1*a* in the leading driving pulse Na is set to be greater than or equal to 0.2 Tc and less than or equal to 0.3 Tc. This time Wca is shorter than a duration Wcb of the second preliminary expansion portion p1*b* in the following driving pulse Nb, which will be mentioned later, and to be more specific, is approximately 64% of Wcb. Accordingly, the pressure change when the pressure chamber 25 expands as a result of the application of the first preliminary expansion portion p1*a* to the piezoelectric element 17 is greater than in the case of the following driving pulse Nb. Due to this pressure change mutually acting on adjacent pressure chambers 25, there is a trend, in the case where inks are ejected simultaneously from multiple adjacent nozzles 27, for the flight speeds of the ejected ink droplets that are located toward the central area in the nozzle row direction to be higher than the flight speeds of the ink droplets that are located at the end areas in the nozzle row direction, as will be described later. On the other hand, the duration Wha of the first expansion hold portion p2*a* in the leading driving pulse Na is longer than the duration Whb of a second expansion hold portion p2*b* in the following driving pulse Nb. Accordingly, the constriction of the pressure chamber 25 caused by the next first constriction portion p3*a* is carried out after the pressure vibration occurring when the pressure chamber 25 is expanded by the first preliminary expansion portion p1*a* has been dampened to a certain extent, and thus the overall flight speed of the ink droplets ejected from the nozzles 27 is slower than the fright speed in the case of the following driving pulse Nb.

When the leading driving pulse Na configured as described above is supplied to the piezoelectric element 17, first, the piezoelectric element 17 constricts in the element lengthwise direction due to the first preliminary expansion portion p1*a*, and as a result, the pressure chamber 25 expands from a base volume corresponding to the base potential VB to an expanded volume corresponding to the expansion potential VH. Due to this expansion, the surface of the ink at the nozzle 27 (the meniscus) is significantly retracted toward the pressure chamber 25, and ink is supplied to within the pressure chamber 25 from the reservoir 23 through the ink supply opening 24. This expanded state of the pressure chamber 25 is maintained during the interval in which the first expansion hold portion p2*a* is supplied.

After the expanded state has been held by the first expansion hold portion p2*a*, the first constriction portion p3*a* is supplied to the piezoelectric element 17, and the piezoelectric element 17 extends. As a result, the pressure chamber 25 constricts from the expanded volume to a constricted volume corresponding to the constriction potential VL. Accordingly, the ink within the pressure chamber 25 is pressurized, pushing the central portion of the meniscus in the ejection direction, and the portion that has been pushed extends as a liquid column. Following the first constriction portion p3*a*, the constricted state of the pressure chamber 25 is held for a set amount of time as a result of the first constriction hold portion p4*a*. During this period, the liquid column separates from the meniscus, and the separated portion is ejected from the nozzle 27, traveling toward the recording medium as an ink droplet. The pressure of the ink within the pressure chamber 25, which has decreased due to the ejection of the ink, once again rises due to the unique vibration thereof. The first damping expansion portion p5*a* is applied to the piezoelectric element 17 at the time of this rise, causing the pressure chamber 25 to expand from the constricted volume to a damping expanded volume. Accordingly, pressure fluctuations of the ink within the pressure chamber 25 (that is, residual vibrations) are decreased. The damping expanded volume of the pressure chamber 25 is held for a set amount of time by the first damping hold portion p6*a*. After that, the pressure chamber 25 is gradually expanded and returned to its normal volume by the first return expansion portion p7*a*.

The following driving pulse Nb is configured of the second preliminary expansion portion p1*b* (corresponding to a second retraction portion), the second expansion hold portion p2*b* (corresponding to a second hold portion), a second constriction portion p3*b* (corresponding to a second expulsion portion), a second constriction hold portion p4*b*, a second damping expansion portion p5*b*, a second damping hold portion p6*b*, and a second return expansion portion p7*b*. The second preliminary expansion portion p1*b* is a waveform portion in which the potential rises in the positive direction from the base potential VB to the expansion potential VH at a constant slope, whereas the second expansion hold portion p2*b* is a waveform portion in which the ending potential of the second preliminary expansion portion p1*b*, or the expansion potential VH, is held constant. Meanwhile, the second constriction portion p3*b* is a waveform portion in which the potential drops in the negative direction from the expansion potential VH to the constriction potential VL, whereas the second constriction hold portion p4*b* is a waveform portion in which the constriction potential VL is held constant. Furthermore, the second damping expansion portion p5*b* is a waveform portion in which the potential rises in the positive direction from the constriction potential VL to the damping expansion potential VM1 at a constant slope; the second damping hold portion p6*b* is a waveform portion in which the damping expansion potential VM1 is held constant; and the second return expansion portion p7*b* is a waveform portion in which the potential returns to the base potential VB from the damping expansion potential VM1.

The second constriction portion p3*b* has a characteristic in that it is configured of a first constriction element p3*ba* (corresponding to a former-stage expulsion element) in which the potential drops in the negative direction from the expansion potential VH, an intermediate hold element p3*bb* in which the ending potential of the first constriction element p3*ba*, which is an intermediate hold potential VMH, is held for a set amount of time, and a second constriction element p3*bc* (corresponding to a latter-stage expulsion element) in which the potential drops in the negative direction from the intermediate hold potential VMH. In other words, the second constriction portion p3*b* is configured so that changes in potential stop for a short amount of time during the change from the expansion potential VH to the constriction potential VL. Meanwhile, the potential slope (the amount of change in the potential per unit of time) of the second constriction element p3*bc* is set so as to have a sharper slope than the potential slope of the first constriction element p3*ba*.

As described above, the duration Wcb of the second preliminary expansion portion p1*b* in the following driving pulse Nb is set so as to be longer than the duration Wca of the first preliminary expansion portion p1*a* in the leading driving pulse Na. Accordingly, the size of the pressure change per unit of time when the pressure chamber 25 expands as a result of the second preliminary expansion portion p1*b* being applied to the piezoelectric element 17 is smaller than when the first preliminary expansion portion p1*a* of the leading driving pulse Na is applied. Due to this pressure change mutually acting on adjacent pressure chambers 25, there is a trend, in the case where inks are ejected simultaneously from multiple adjacent nozzles 27, for the flight speeds of the ejected ink droplets that are located at the end areas of the ejecting nozzle group to be higher than the flight speeds of the ink droplets that are located toward the central portion in the ejecting nozzle group, as will be described later. Meanwhile, the duration Whb of the second expansion hold portion p2*b* in the following driving pulse Nb is shorter than the duration Wha of the first expansion hold portion p2*a* in the leading driving pulse Na. Then, the pressure chamber 25 is constricted by the next second constriction portion p3*b* using the pressure vibrations occurring when the pressure chamber 25 is expanded by the second preliminary expansion portion p1*b*, and thus the overall flight speeds of the ink droplets ejected from the nozzles 27 is higher than in the case of the leading driving pulse Na. The higher the flight speed of the ink droplets, the stronger the trend is for the flight speeds of the ink droplets that are located at the end areas of the ejecting nozzle group to be higher than the flight speeds of the ink droplets that are located toward the central portion in the ejecting nozzle group.

When the following driving pulse Nb configured as described above is supplied to the piezoelectric element 17, first, the piezoelectric element 17 constricts in the element lengthwise direction due to the second preliminary expansion portion p1*b*, and as a result, the pressure chamber 25 expands from the base volume corresponding to the base potential VB to an expanded volume corresponding to the expansion potential VH. The meniscus at the nozzle 27 is retracted toward the pressure chamber 25, and ink is supplied to within the pressure chamber 25 from the reservoir 23 through the ink supply opening 24. This expanded state of the pressure chamber 25 is maintained during the interval in which the second expansion hold portion p2*b* is supplied.

After the expanded state has been maintained by the second expansion hold portion p2*b*, the second constriction portion p3*b* is supplied, and the piezoelectric element 17 extends as a result. As a result, the pressure chamber 25 constricts from the expanded volume to a constricted volume corresponding to the constriction potential VL. As described above, the second constriction portion p3*b* is configured of the first constriction element p3*ba*, the intermediate hold element p3*bb*, and the second constriction element p3*bc*, and thus in this second step of the change, the pressure chamber 25 first constricts from the expanded volume to an intermediate volume corresponding to the intermediate hold potential VMH as a result of the first constriction element p3*ba*. Accordingly, the ink within the pressure chamber 25 is pressurized, pushing the central portion of the meniscus in the ejection direction, and the portion that has been pushed extends as a liquid column. Next, the intermediate hold element p3*bb* is supplied, and the intermediate volume is maintained for a short amount of time Wb. As a result, the extension of the piezoelectric element 17 temporarily stops. During this period, the liquid column in the central portion of the meniscus extends in the ejection direction due to the inertia force, but because the ink within the pressure chamber 25 is not pressurized during this time, the extension of the liquid column is suppressed by that amount.

After the holding caused by the intermediate hold element p3*bb*, the piezoelectric element 17 extends, due to the second constriction element p3*bc*, in a quicker manner than when the first constriction element p3*ba* is applied, and the volume of the pressure chamber 25 is suddenly pressurized from the intermediate volume to the constricted volume (a second change process). Through this, the entire meniscus is pushed outward in the ejection direction, and the trailing end of the liquid column accelerates. Following the second constriction portion p3*b*, the constricted state of the pressure chamber 25 is held for a set amount of time as a result of the second constriction hold portion p4*b*. As a result of this series of processes, the meniscus and the liquid column separate from each other, and the separated portion is ejected from the nozzle 27 and travels as an ink droplet. Here, because the trailing portion of the liquid column accelerates due to the second constriction element p3*bc*, not only is the flight speed of the ink droplet increased, but the occurrence of satellite liquid droplets that separate from the main ink droplets is suppressed.

Then, the second damping expansion portion p5*b* is applied to the piezoelectric element 17 at the timing at which the pressure of the ink within the pressure chamber 25 that had dropped due to the ink ejection once again rises, and the pressure chamber 25 expands from the constricted volume to the damping expanded volume. Accordingly, residual vibrations of the ink within the pressure chamber 25 are decreased. The damping expanded volume of the pressure chamber 25 is held for a set amount of time by the second damping hold portion p6*b*. After that, the pressure chamber 25 is gradually expanded and returned to its normal volume by the second return expansion portion p7*b*.

Figure 5A:
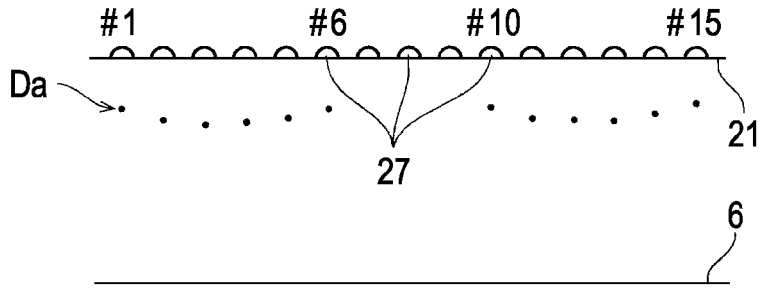
FIGS. 5A through 5C are schematic diagrams illustrating flight states of ink droplets when ink is ejected toward a recording medium from respective nozzles of which a nozzle row is configured in a printer according to the invention.
Figure 5B:
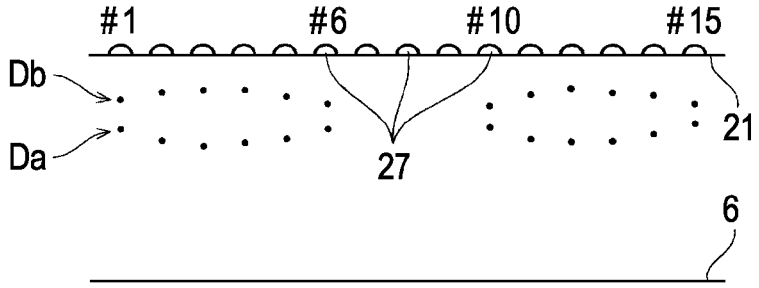
Figure 5C:
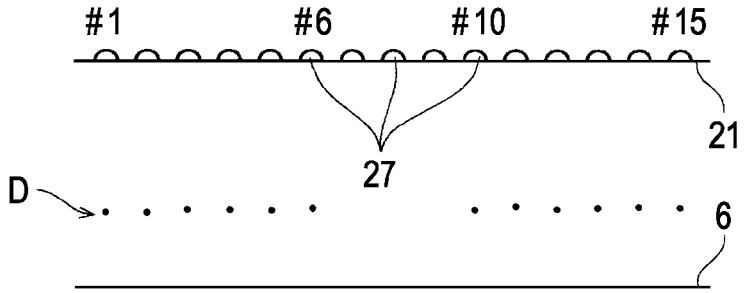
Figure 6A:
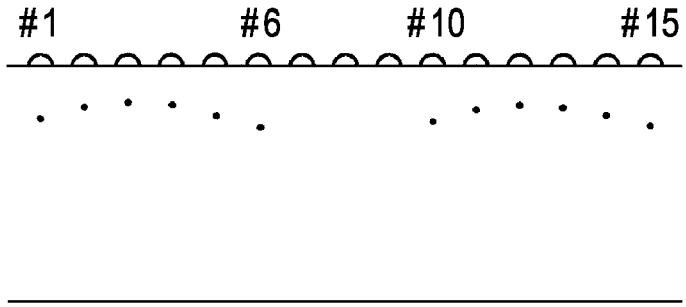
FIGS. 6A through 6C are schematic diagrams illustrating flight states of ink droplets when ink is ejected toward a recording medium from respective nozzles of which a nozzle row is configured in a past printer.
Figure 6B:
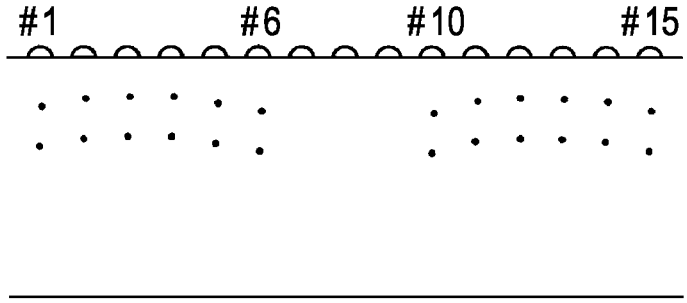
Figure 6C:
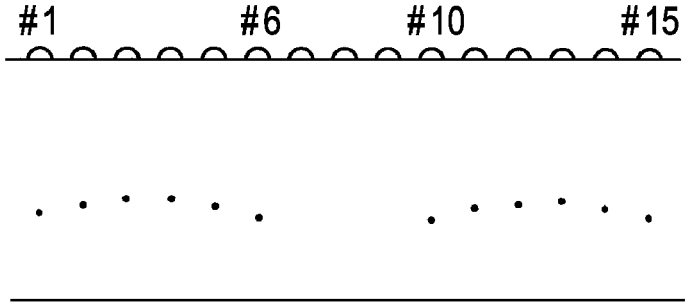

FIGS. 5A through 5C are diagrams illustrating the flight of ink droplets when ink is ejected toward a recording medium from nozzles of the printer 1 according to the invention, as viewed from the direction perpendicular to the direction in which the ink travels (that is, from the side). Note that in FIGS. 5A through 5C, the straight lines in the upper areas indicate the nozzle surface of the recording head 2, or in other words, the nozzle substrate 21, whereas the straight lines in the lower areas indicate the recording surface of the recording medium such as the recording paper 6. Furthermore, only the nozzles 27 #1 through #15 of all of the nozzles of which the nozzle row is configured (that is, the nozzles #1 to #180) are shown. Furthermore, FIGS. 5A through 5C illustrate the case where, of the nozzles 27 #1 through #15, ink is ejected from nozzles 27 #1 through #6 and #10 through #15, whereas ink is not ejected from nozzles 27 #7 through #9 (that is, 6 on and 3 off). Note that the nozzles 27 #1 through #6 and the nozzles 27 #10 through #15 configure individual respective nozzle groups (adjacent nozzle groups).

As described earlier, when ink is simultaneously ejected from multiple adjacent nozzles 27 using the aforementioned leading driving pulse Na, adjacent pressure chambers 25 are mutually affected by the pressure vibrations occurring during the ink ejection; as a result, as shown in FIG. 5A, there is a trend for the flight speed of ink droplets Da to decrease the closer the nozzles 27 are located toward the end areas of adjacent nozzle groups and for the flight speed of the ink droplets Da to increase the closer the nozzles 27 are located toward the central areas of the adjacent nozzle groups. Accordingly, observing the ink droplets Da ejected from these nozzle groups shows that the ink droplets Da travel in a state that is essentially an arched shape whose central portion bulges downward (toward the recording medium). Meanwhile, when ink is simultaneously ejected from multiple adjacent nozzles 27 using the following driving pulse Nb, there is a trend, as shown in FIG. 5B, for the flight speed of ink droplets Db to increase the closer the nozzles 27 are located toward the end areas of adjacent nozzle groups and for the flight speed of the ink droplets Db to decrease the closer the nozzles 27 are located toward the central areas of the adjacent nozzle groups. Accordingly, observing the ink droplets Db ejected from these nozzle groups shows that the ink droplets Db travel in a state that is essentially an arched shape whose central portion bulges upward (toward the nozzle surface). The flight speed of the ink droplets Db ejected as a result of the following driving pulse Nb is greater than the flight speed of the ink droplets Da ejected as a result of the leading driving pulse Na. To be more specific, the flight speed of the ink droplets Db that are ejected simultaneously as a result of the following driving pulse Nb and that are located on the end areas of adjacent nozzle groups is greater than or equal to 1.1 times and less than or equal to 3.6 times the flight speed of the ink droplets Da that are ejected simultaneously as a result of the leading driving pulse Na and that are located on the end areas of adjacent nozzle groups. Accordingly, as shown in FIG. 5C, the ink droplet Da and the ink droplet Db ejected from the same nozzle 27 combine into a single ink droplet D during the time from when the droplets are ejected from the nozzle 27 to when the droplets land upon the recording surface of the recording medium. In this embodiment, the interval Pd from the end of the leading driving pulse Na to the start of the following driving pulse Nb is set to be greater than or equal to 0.2 Tc and less than or equal to 0.3 Tc, and thus the ink droplets Da and the ink droplets Db can be combined with more certainty by the time the droplets land upon the recording medium. For example, assuming the distance from the nozzle surface to the recording surface of the recording medium is 1.5 mm, the ink droplets Da and the ink droplets Db combine at a location that is within 1 mm from the nozzle surface. Observing the post-combination ink droplets D shows that the ink droplets D travel toward the recording medium along an almost horizontal line. Accordingly, the dot groups formed when the inks land upon the recording medium are also arranged along a single straight line when viewed from above. In other words, positional skew of the ink droplets in the direction perpendicular to the nozzle row is suppressed. As a result, a drop in the quality of the image or the like recorded on the recording medium is suppressed.

Incidentally, the invention is not limited to the above-described embodiment, and many variations based on the content of the appended claims are possible.

Although a so-called logitudinally-vibrating piezoelectric element 17 is described as an example of a pressurizing unit in the aforementioned embodiment, it should be noted that the pressurizing unit is not limited thereto, and, for example, a so-called longitudinally-vibrating piezoelectric element can be employed as well. In such a case, with respect to the examples of the leading driving pulse Na and the following driving pulse Nb, the direction of the change in the potential of the driving pulse, or in other words, the up-down direction of the waveform, is inverted.

Finally, the invention is not limited to a printer, and can be applied in any liquid ejecting apparatus capable of using multiple driving signals to control the ejection, such as a plotter, a facsimile apparatus, a copy machine, or the like of various types of ink jet recording apparatuses; liquid ejecting apparatuses aside from recording apparatuses, such as, for example, display manufacturing apparatuses, electrode manufacturing apparatuses, chip manufacturing apparatuses; and so on. In such display manufacturing apparatuses, liquids having R (red), G (green), and B (blue) coloring materials are ejected from coloring material ejecting heads. Meanwhile, in electrode manufacturing apparatuses, electrode materials are ejected in liquid form from electrode material ejection heads. In chip manufacturing apparatuses, bioorganic matters are ejected in liquid form from bioorganic matter ejection heads.

What is claimed is:

1. A liquid ejecting apparatus comprising:

a liquid ejecting head including a nozzle that ejects a liquid, a pressure chamber that communicates with the nozzle, and a pressurizing unit that causes a pressure change in a liquid within the pressure chamber, the liquid ejecting head being capable of ejecting the liquid from the nozzle as a result of an operation performed by the pressurizing unit; and a driving signal generation unit that generates a driving signal including an ejection driving pulse for driving the pressurizing unit and causing the liquid to be ejected from the nozzle, the liquid ejecting apparatus causing liquid droplets to be ejected from the nozzle and land upon a landing target while moving the landing target and the liquid ejecting head relative to each other using the movement unit, wherein the driving signal generation unit generates a leading driving pulse that is ahead in a unit cycle and a following driving pulse that follows the leading driving pulse;

the leading driving pulse is set so that, in the case where liquid droplets are ejected simultaneously from multiple adjacent nozzles, the flight speed of the ejected liquid droplets located toward the central area in a nozzle row direction is higher than the flight speed of the ejected liquid droplets located toward the end areas in the nozzle row direction; and the following driving pulse is set so that, of the liquid droplets simultaneously ejected from the multiple adjacent nozzles, the flight speed of the ejected liquid droplets located toward the end areas is higher than the flight speed of the liquid droplets located toward the central area.

2. The liquid ejecting apparatus according to claim 1, wherein the flight speed of the liquid droplets that are ejected from the nozzles as a result of the following driving pulse and that are located on the end areas is greater than or equal to 1.1 times and less than or equal to 3.6 times the flight speed of the liquid droplets that are ejected from the nozzles as a result of the leading driving pulse and that are located on the end areas.

3. A liquid ejecting apparatus comprising:

a liquid ejecting head including a nozzle that ejects a liquid, a pressure chamber that communicates with the nozzle, and a pressurizing unit that causes a pressure change in a liquid within the pressure chamber, the liquid ejecting head being capable of ejecting the liquid from the nozzle as a result of an operation performed by the pressurizing unit; and a driving signal generation unit that generates a driving signal including an ejection driving pulse for driving the pressurizing unit and causing the liquid to be ejected from the nozzle, the liquid ejecting apparatus causing liquid droplets to be ejected from the nozzle and land upon a landing target while moving the landing target and the liquid ejecting head relative to each other using the movement unit, wherein the driving signal generation unit generates a leading driving pulse that is ahead in a unit cycle and a following driving pulse that follows the leading driving pulse;

the leading driving pulse is a voltage waveform including a first retraction portion for changing the potential in a first direction and retracting the meniscus at the nozzle toward the pressure chamber, a first hold portion in which the ending potential of the first retraction portion is held constant, and a first expulsion portion for changing the potential in a second direction that is the direction opposite to the first direction and pushing the meniscus that has been retracted by the first retraction portion outward in the ejection direction;

the following driving pulse is a voltage waveform including a second retraction portion for changing the potential in the first direction and retracting the meniscus at the nozzle toward the pressure chamber, a second hold portion in which the ending potential of the second retraction portion is held constant, and a second expulsion portion for changing the potential in the second direction and pushing the meniscus that has been retracted by the second retraction portion outward in the ejection direction;

the second expulsion portion is configured of a former-stage expulsion element in which the potential changes from the ending potential of the second retraction portion to the second direction, an intermediate hold element in which the ending potential of the former-stage expulsion element is held constant, and a latter-stage expulsion element in which the potential changes from the ending potential of the former-stage expulsion element to the second direction; and when the unique vibration cycle of the liquid within the pressure chamber is taken as Tc, the duration of the first retraction portion is greater than or equal to 0.2 Tc and less than or equal to 0.3 Tc.

4. The liquid ejecting apparatus according to claim 3, wherein the period from the end of the leading driving pulse to the beginning of the following driving pulse is greater than or equal to 0.2 Tc and less than or equal to 0.3 Tc.

5. The liquid ejecting apparatus according to claim 3, wherein the duration of the second retraction portion of the following driving pulse is set to be longer than the duration of the first retraction portion of the leading driving pulse; and the duration of the first hold portion of the leading driving pulse is set to be longer than the duration of the second hold portion of the following driving pulse.

* * * * *